United States Patent [19]

Kondur, Jr.

[11] 4,123,182

[45] Oct. 31, 1978

[54] CAM DRIVE FOR MATRIX PRINT HEADS AND THE LIKE

[75] Inventor: Nicholas Kondur, Jr., Riverton, Wyo.

[73] Assignee: LRC, Inc., Riverton, Wyo.

[21] Appl. No.: 686,708

[22] Filed: May 17, 1976

[51] Int. Cl.[2] ..... B41J 19/50; B41J 19/56; B41J 19/20

[52] U.S. Cl. ..... 400/328; 400/320; 400/372; 400/120; 400/578; 74/567; 101/93.15

[58] Field of Search ..... 197/1 R, 82, 90; 74/567; 101/93.15, 93.16; 346/139; 178/23 R, 40

[56] References Cited

U.S. PATENT DOCUMENTS

| | | | |
|---|---|---|---|
| 3,167,166 | 1/1965 | Schiebeler | 197/1 R |
| 3,429,414 | 2/1969 | Bradbury | 197/82 |
| 3,670,861 | 6/1972 | Zenner et al. | 197/64 |
| 3,708,050 | 1/1973 | McCarthy, Jr. | 197/1 R |
| 3,750,792 | 8/1973 | Liles | 197/1 R |
| 3,986,594 | 10/1976 | Kondur, Jr. | 197/82 |
| 3,993,181 | 11/1976 | Potma et al. | 197/1 R |
| 4,024,942 | 5/1977 | Kawaji | 197/127 R |

FOREIGN PATENT DOCUMENTS

| | | | |
|---|---|---|---|
| 1,316,234 | 5/1973 | United Kingdom. | |
| 1,336,688 | 11/1973 | United Kingdom | 197/1 R |

*Primary Examiner*—William Pieprz
*Attorney, Agent, or Firm*—John E. Reilly

[57] ABSTRACT

In a print head assembly for calculators and the like, the print head is reversibly driven in a print and return direction transversely of the direction of advancement of the recording medium by a drum segment having a cam drive in the form of an endless helical groove which extends along a cylindrical surface of revolution between opposite ends of a drive axle mounted in driving relation to the print head so that rotation of the drum will impart translational movement to the print head through a suitable drive member engaged by the helical groove at a preselected rate of speed both in the print and return direction.

13 Claims, 5 Drawing Figures

CAM DRIVE FOR MATRIX PRINT HEADS AND THE LIKE

This invention generally relates to novel and improved print head drive means and more particularly relates to a cam drive for a matrix print head for reversibly driving the print head between opposite end limits of travel in a print and return direction.

BACKGROUND OF THE INVENTION

Copending application for Pat. Ser. No. 527,603 filed Nov. 24, 1974 for SERIAL IMPACT CALCULATOR PRINTER, now U.S. Pat. No. 3,986,594 and assigned to the assignee of the present invention discloses apparatus in which a matrix print head of the type including a compact arrangement of solenoid-actuated print wires can be reversibly driven transversely of the direction of movement of the recording medium at a closely controlled rate by a continuous loop, helical drive surface on a cylindrical roller which is rotatably driven by a synchronous motor drive at one end of the roller. Broadly, the configuration of the helical drive which is formed in the cylindrical surface of the roller will determine the rate of speed of the print head in advancing from a start position across the width of the recording medium for the printing operation followed by reverse movement in the return direction back to the starting point for the next line of print. In the preferred form disclosed in the hereinbefore referred to U.S. Pat. No. 3,986,594, the loop extends between diametrically opposed locations on opposite sides of a full cylindrical roller and the surface of revolution formed by the loop is such that when rotated it will establish a dwell portion to permit the print head carrier to undergo controlled acceleration to a constant velocity for printing; and at the end of the print line will cause the print head to rapidly decelerate as it undergoes a reversal in direction then to accelerate in the return direction back to its home or starting position.

SUMMARY OF THE INVENTION

The present invention is directed to a novel and improved cam drive of the type described which specifically is adaptable for use in reversibly driving a print head at a controlled rate of speed across a print or recording medium, and a principal object of the present invention is to provide for a novel and improved continuous loop cam drive characterized by its simplicity of construction, ease of fabrication and assembly, as well as its versatility in use.

It is another object of the present invention to provide for a novel and improved drive for a dot matrix print head in which a continuous loop drive is formed on a generally cylindrical surface of revolution in such a way as to greatly minimize the size and weight of the unit; and further wherein the configuration of the loop in cooperation with its mounting and disposition with respect to the print head enables printing in either direction of advancement of the print head.

A further object of the present invention is to provide a rotatable cam drive for a matrix print head comprised of telescoping cylindrical parts having complementary cam surfaces arranged together in closely spaced relation to one another to form an endless helical drive surface of predetermined configuration to impart the desired translational drive characteristics to the print head as the cam drive is rotated at a predetermined rate of speed.

In accordance with the present invention, a novel and improved cam drive for a print head has been devised which in its preferred form is specifically adaptable for use in reversibly driving a dot matrix print head at a predetermined rate of speed in the print and return directions. Conventionally the print head is mounted on a print head carrier having a drive member in the form of a downwardly projecting pin. The cam drive is journaled for rotation beneath the print head carrier so that the pin is engaged by an endless helical loop to impart translational, reversible movement to the print head. An important feature of the present invention resides in the construction of a loop or cam drive from a pair of telescoping drum segments or cylindrical parts each provided with a complementary cam surface at one terminal end each in the form of a continuous or endless helical rib extending between opposite end limits of travel of the print head and between diametrically opposed locations on the drum. One of the drum segments includes a common central drive shaft or sleeve which permits the cam to be journaled for rotation beneath the print head carrier and to be rotatably driven by a motor drive keyed to one end of the cam. Preferably the cylindrical drum segments each is in the form of a right cylinder of hollow construction terminating at one end or base in a generally helical rib extending at an oblique angle to the axis of the cylinder so as to require only that amount of material necessary to rigidly support the cam surfaces about the central drive axis.

The above and other objects, advantages and features of the present invention will become more readily understood and appreciated from a consideration of the following description of a preferred embodiment when taken together with the accompanying drawings.

DETAILED DESCRIPTION OF THE PREFERRED EMBODIMENT

Figure 1:
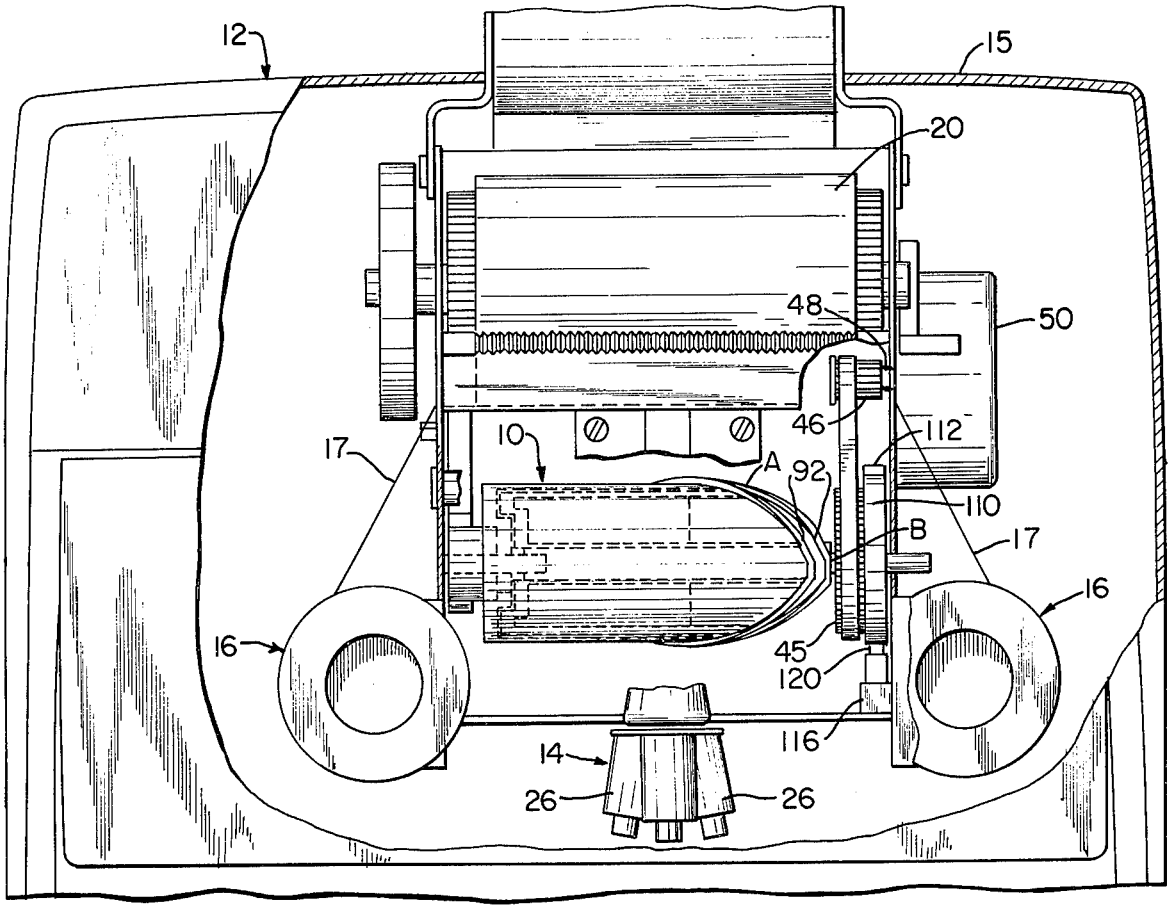
FIG. 1 is a plan view of a calculator printer with portions broken away to illustrate the mounting and assembly of the print head drive.

The present invention may be best exemplified by describing the construction and operation of a preferred form of print head drive 10 when mounted in a calculator 12 in driving relation to a print head assembly 14. As a setting for the present invention, the calculator 12 is of the type described and set forth in detail in said copending application for patent for Serial Impact Calculator Printer, Ser. No. 527,603; and the calculator unit 12 is seen to be broadly comprised of an outer housing 15, a ribbon spool assembly 16 for a print ribbon 17. The recording or print medium R may be defined by a paper roll which is guided for advancement upwardly along a predetermined path by paper feed assembly 20. The print head 14, ribbon spool assembly 16 and paper feed assembly 20 are mounted in a main support or frame having opposite sides 23 and 24 mounted in the housing. In the calculator referred to a keyboard, not shown, will through conventional electronics and logic control perform the necessary calculations to generate a combination of electrical signals which controls actuation of selected solenoid actuators 26 in the print head to impart driving motion to a series of print wires, not shown, which are carried by the print head assembly 14 to strike the print ribbon and form a dot matrix number or character on the recording medium arm.

Figure 4:
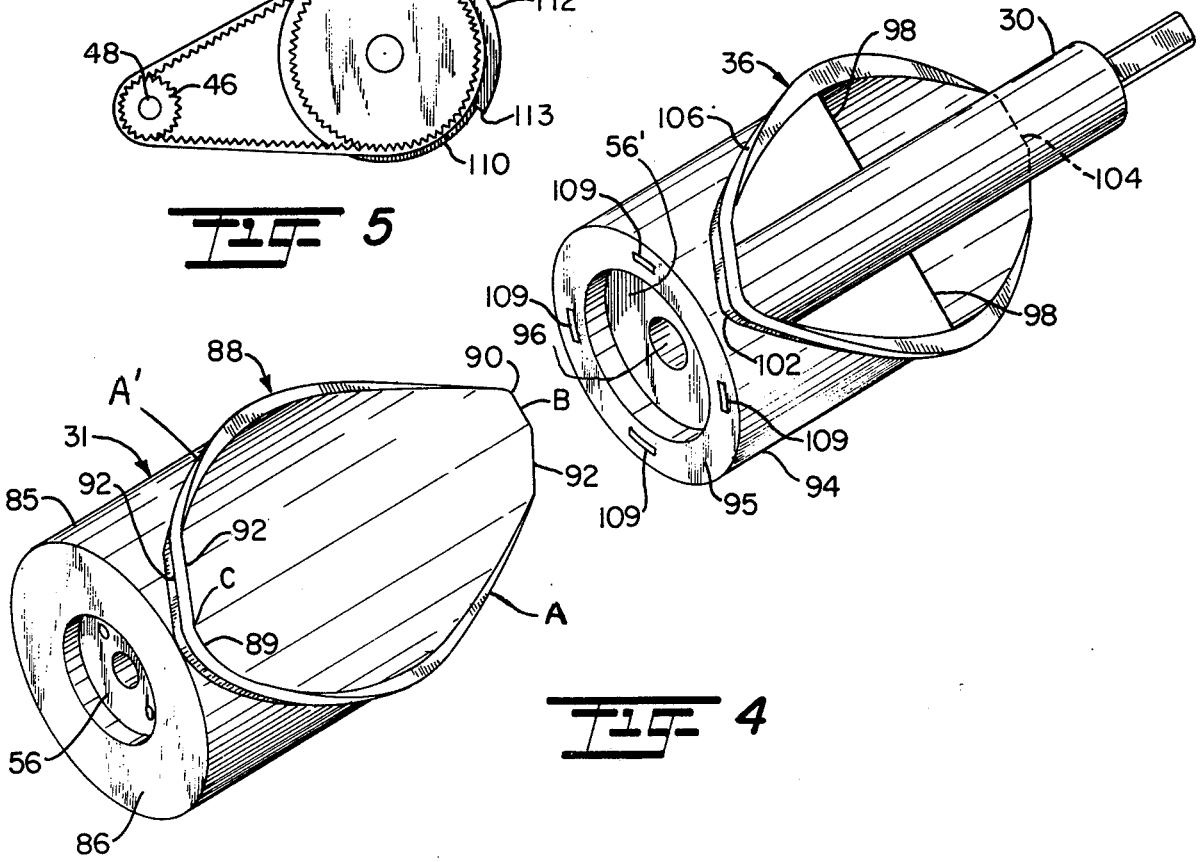
FIG. 4 is an exploded perspective view of the cylindrical drum portions making up the print head drive.

In accordance with the present invention, the print head assembly 14 is reversibly driven transversely of the direction of movement of the recording medium R at a closely controlled rate of speed by the print head drive 10. As shown in FIGS. 1 to 4, the print head drive 10 takes the form of a drum broadly comprised of a drive axle 30 and outer generally cylindrical drum members 31 and 32 defining a helical groove 34 therebetween in the form of an endless loop which extends along a path from a point adjacent to one end of the drive axle 30 to a point at the opposite end which is 180° removed. The helical groove 34 is preferably defined by complementary cam surfaces 35 and 36 on members 31 and 32, respectively, arranged in closely spaced relation to one another and sized to permit insertion of a downwardly projecting stud 38 on head carrier 40 of the print head assembly 14. The drive 10 is disposed for rotation between opposite side frames 23 and 24 by a drive shaft 42 forming an axial extension of one end of the axle 30 which is journaled in a bearing 43 in frame 24 and inserted in a speed reduction gear 45, the latter being driven off of pinion 46 on motor drive shaft 48 of the motor drive unit 50. As shown in FIGS. 1 and 4 the shaft 42 has diametrically opposed flat surface portions 52 so that when the extension is inserted or keyed into a correspondingly formed opening in the gear 45, it is fixed for rotation with the gear to rotate the drive axle 30. The opposite end of the drive axle 30 has a bearing 56 which is journaled on a fixed shaft 58 projecting inwardly from and fixed to the frame 23. A ribbon feed pawl 60 includes an inner ring 62 disposed in surrounding relation to an annular eccentric member 63 which is journaled on the shaft 58. Eccentric 63 has a laterally projecting pin 64 inserted into one of the bores 65 and 65' formed in the end of the drive axle 30 on diametrically opposed sides of the central opening in the bearing 56. In this way, rotation of the drive shaft 48 is imparted by the drum 10 to the eccentric 63 and pawl 60 to drive the free end 61 of the pawl 60 into and out of engagement with teeth 65 on a ratchet wheel 66 which is keyed to one end of the paper feed roll shaft 70 so as to index or advance the paper in direct correlation with the printing operation. A pin 72 projects laterally from the side of the pawl 60 through a slot 74 in the side frame 233 the slot having oppositely directed downwardly inclined portions 75 and 76 somewhat in the form of an inverted V so that when the sleeve 62 of the pawl 60 is caused to rotate in an eccentric motion by the member 63, the lost-motion connection between the pin 72 and slot 74 will impart vertical motion in an oval path to the free end 78 of the pawl 60 to advance it into and away from engagement with one of the ratchet teeth 65. Specifically, the free end 78 will swing upwardly into engagement with one of the teeth 65 to carry the ratchet wheel over a limited distance in a generally clockwise direction as viewed in FIG. 3 to advance or index the record medium R one line or space; thereafter the free end 78 will swing downwardly away from the ratchet wheel to advance forwardly beneath the next tooth in succession in preparation for the next indexing operation. The pawl 60 will advance through one complete revolution for each revolution of the cam drive 10 and, in a manner hereinafter described, will move upwardly into engagement with a tooth as the print head 14 undergoes movement in a return direction between printing operations. In this relation, the function of the pawl and its operation in association with a detent, not shown, corresponds to that described in the hereinbefore referred to copending application Ser. No. 527,603. Similarly, the construction and operation of the ribbon spool assembly in correlation with the indexing of the paper or record medium R is set forth and described in said copending application for patent and therefore is not described in detail herein.

Now considering the construction and arrangement of the preferred form of cam drive 10, as best seen from FIG. 4, the main drive member is comprised of two generally cylindrical drum segments 31 and 32 adapted to be joined together such that the segment 32 is movable into inner concentric relation to the outer sleeve segment 31. The outer sleeve 31 includes a cylindrical surface 85 terminating in a circular end portion 86 in surrounding relation to the bearing 56 which receives the shaft 58 on the frame 23. The opposite end of the cylindrical surface 85 has a radially outwardly projecting cam or rib 35 in the form of an endless loop which extends from a point 89 adjacent to the outer peripheral edge of the end portion 86 along a helical path to an opposite end point 90 which is 180° removed from the end point 89. The outwardly projecting rib 35 forms one side of the cam surface or helical groove 34 as described and has a side or cam surface 35 which is formed with straight sections 92 of limited length each extending into one of the end points 89 and 90 and forming a reduced pressure angle for advancement of the drive pin 38. In turn, the drum segment 32 similarly includes a cylindrical surface 94 terminating in an annular end portion 95 and an inner bearing portion 56' which defines a central opening formed at one end of the drive axle 30 which extends along the main longitudinal axis of the cylindrical part 32. The drive axle 30 is in the form of an elongated sleeve which is centered with respect to the cylindrical surface 94 by radially extending webs 98 which are arranged at equally spaced, circumferential intervals between the surface 94 and axle 30. In the form shown, three webs are shown at 90° intervals and extend from the end portion 95 lengthwise to the opposite end of the surface 94. The cylindrical surface 94 in a manner corresponding to that of the cylindrical surface 85 terminates in an upstanding rib or cam 36 which is correspondingly configured to be complementary with the rib 88 of the outer sleeve 31. Thus, the rib 36 also extends in the form of an endless loop from an end point 102 located at the outer peripheral edge of the end portion 95 along a generally helical path around the cylindrical surface 94 to an opposite end point 104 which is removed 180° from the point 102. Again, the side of the rib or surface 36 is disposed in facing relation to the cam surface 35 and has straight sections 92' aligned with and corresponding to the sections 92 on the cam surface 35.

Figure 2:
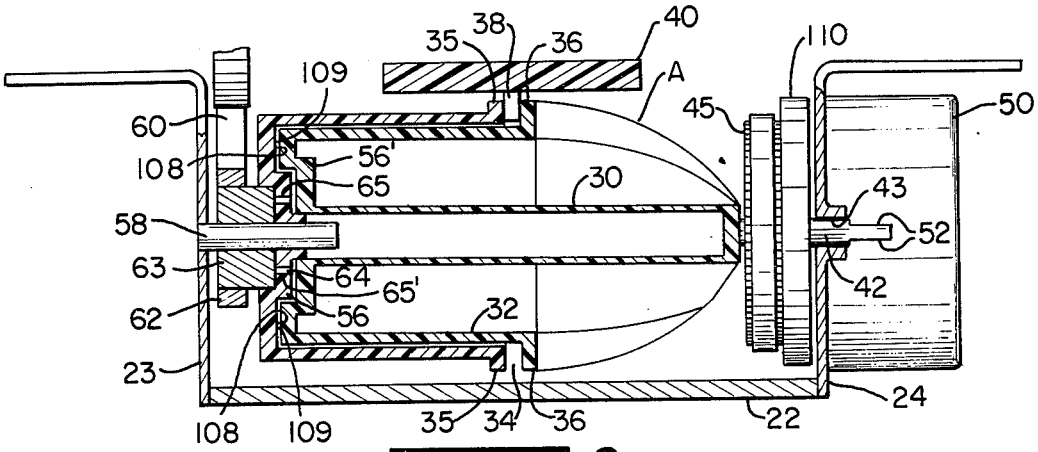
FIG. 2 is a cross sectional view enlarged and in more detail of the print head drive in assembled relation to the calculator printer shown in FIG. 1.
Figure 3:
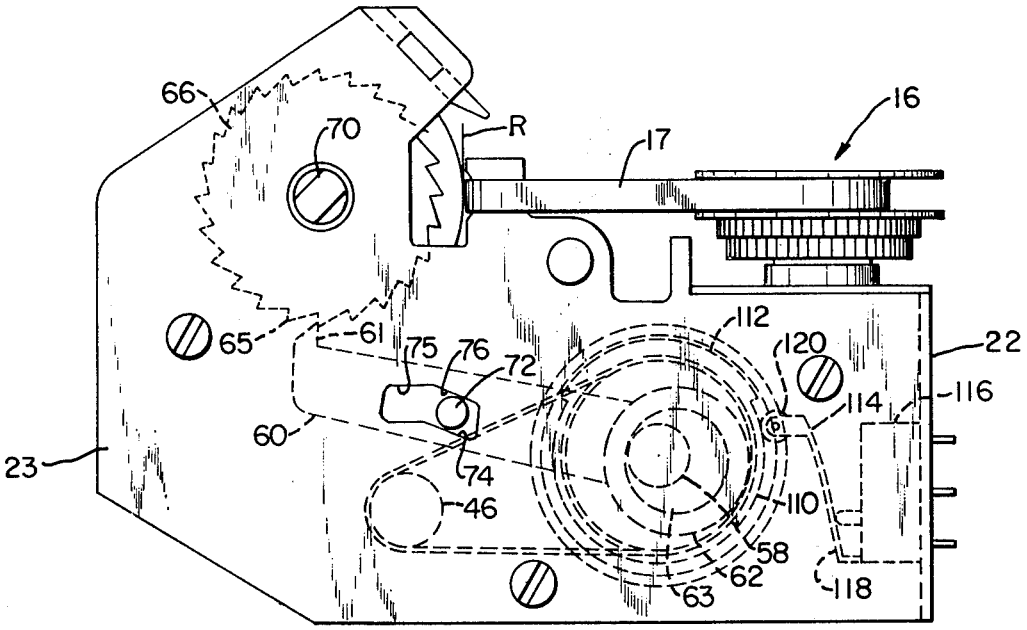
FIG. 3 is a side view of the calculator shown in FIG. 1 and illustrating mounting and disposition of an eccentric pawl at one end of the print head drive for indexing the record medium.
Figure 5:
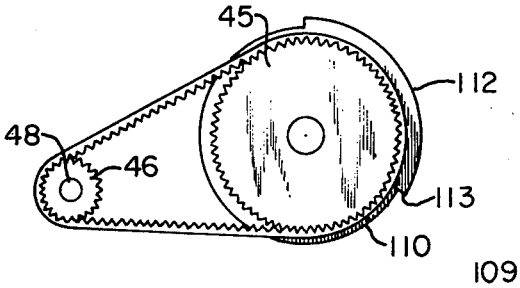
FIG. 5 is a view in detail of the power transmission drive and cam roller at one end of the cam drive.

The inner concentric segment 32 is assembled by insertion into the outer sleeve 31 in such a way as to establish uniform spacing between the confronting cam surfaces 35 and 36 by locating ribs 108 located on the inner surface of the end portion 86, as shown in FIG. 2, and which are aligned for limited insertion into shallow slots 109 circumferentially spaced about the end portion 95. The parts may be permanently affixed to one another such as by ultrasonic welding or by application of a suitable bonding agent between the contacting surfaces of the segment 82 and 84. In assembled relation, the helical cam surfaces are uniformly spaced throughout to define the common helical groove 34 for insertion of the drive pin or stud 38 which projects downwardly from the head carrier 40 of the print head assembly 14. Assuming that the drive 10 is caused to undergo a complete revolution or cycle starting at a home position designated A in FIG. 1, the drive pin 38 will be advanced along the helical groove 34 until it reverses at the end of the drum between the end points 90 and 104 and reversed to advance along the opposite side of the loop back to the opposite end. Assuming that the print head is printing as the print head assembly is advanced from right to left, as viewed in FIG. 1, the pawl is driven in a somewhat rearward and upward direction into engagement with the ratchet wheel so that at the end of the travel of the print head at the lefthand margin the upwardly projecting dog on the pawl will advance into engagement with one of the teeth 65 on the ratchet wheel 66. Then as the print head is reversed in travel between the end points 89 and 102 to return to its starting position in traveling from left to right across the record medium during the non-print portion of the cycle the pawl will continue to swing upwardly and advance forwardly into engagement with the ratchet tooth so as to index the ratchet wheel 66 in a counterclockwise direction as viewed in FIG. 3 thereby forcing the record medium to advance one line in preparation for printing the next line in succession. As the print head returns to its home position A the arm or pawl will have cleared the ratchet and will have reached its forward limit of travel under control of the eccentric.

The drum drive 10 is provided with a circular switch control cam 110 mounted on the drive shaft 42 just outwardly of the gear 45 and includes an outer surface 112 which is engaged by a leaf spring control arm 114 on logic level switch 116, the latter mounted at the end of the frame 22. The spring arm is pivoted at its lower end 118 and has a roller 120 at its upper free end which is caused to pass along the outer circumferential cam surface 112 and inwardly along a radial surface 113 to control opening and closing of the logic level switch 116. The logic level switch 116 is opened by the rise or outward travel of the control arm 114 along the surface 112 in reaching the end of the return or non-print portion of the cycle at home position A. To initiate the next cycle an energizing signal is applied to the motor drive from the keyboard, not shown, whereupon the print head is advanced from its starting position A to the point of reversal B, and as the print head is reversed, the switch 115 will activate the print circuit when the arm 114 moves inwardly along the surface 113 whereby to initiate the print operation as the print head starts its travel from right to left across the record medium. The straight sections 92 and 92' which are located just ahead of the point of reversal B form a reduced pressure angle to reduce the torque load on the motor. In a synchronous motor drive, the start up interval or period into the point of reversal will permit the motor to gradually build up to the desired rate of speed for advancing the print head at a constant velocity from right to left as the drive 10 is driven in a counterclockwise direction as viewed in FIG. 3. Thus, the stud 38 will be advanced from the start position A through the reversal point B formed between the end points 90 and 104 then will undergo controlled acceleration as it is reversed in direction to reach a constant velocity for printing from right to left. At the end of the print operation, the stud 38 will rapidly decelerate as it is forced to reverse its direction of travel at the opposite lefthand margin or reversal point C and pass across the reduced pressure angle formed by the straight sections 92 and 92' in order to reduce the torque load on the motor when the print ribbon is advanced by the feed pawl. Thereafter, the stud 38 is caused to advance at a constant velocity in its return travel to the starting position A. The cam profile, or shape, of the helical groove 34 is mathematically calculated to control the pressure angle and rate of speed of the print head as described including the reversal of the print head at opposite margins of the print assembly. As in the form of invention described in our hereinbefore referred to copending application for patent Ser. No. 527,603, the helical groove as formed lends itself to the use of a synchronous motor drive since initial movement from the starting position A through its reversal at B will avoid any instability of the motor in building up to speed as a preliminary to printing. For example, a Molon LMO motor manufactured by Molon Motor and Coil Corp. may be employed, this motor being a 24-pole permanent magnet motor.

It will be recognized from the foregoing detailed description of the preferred form of drum drive that the helical groove 34 as described lends itself particularly well to printing in the reverse direction without modification or substitution of elements. The helical groove 34 is so constructed and configured so as to be entirely symmetrical including correspondingly formed straight sections 92 and 92' which provide reduced pressure angles into and away from the points of reversal B and C, respectively, so that if desired to print from left to right the only change required is to rotate the cam 110 180° and align the cam surface 112 to deenergize the motor as it reaches an opposite starting position A' on the helical groove. As a result, the motor drive 50 may cause rotation of the drum 10 in the same direction with a corresponding start-up interval passing through the opposite straight sections leading into the point of reversal C. The print head will then print from left to right as the motor continues to rotate the drum toward the opposite point of reversal B. The only other modification required is to relocate the eccentric member 63 180° with respect to its driving connection to the drum drive so that the feed pawl 60 will advance or index the paper as the drum drive causes the print head to advance from right to left during the non-print stage of the cycle. This is readily accomplished by reversing the pin 64 on the eccentric 63 into the bore 65' which is 180° removed from the bore 65, as illustrated in FIG. 2.

For the purpose of illustration and not limitation, the print head as represented at 14 may suitably be comprised of a series of five solenoid actuators 26 which respectively drive a series of five aligned print wires, not shown, converging forwardly through the guide housing. As stated, the control circuitry for operation of the motor drive as well as the print head forms no part of the present invention as such and therefore is not shown other than in the relationship between the cam 112 and logic level switch 115.

From the foregoing, it will be appreciated that the drum drive as described is conformable for use in various printing and other applications than the preferred form as described. Preferably, the parts 31 and 32 comprising the drum drive 10 may be composed of a lightweight but durable plastic material, such as a plastic material sold under the trademark NYLATRON GS sold by The Polymer Corp., of Reading, Pa. As shown, the overall length of the assembled cam drive may be on the order of 4.25 inches, not including the axial extension and have a diameter on the order of 2.25 inches. The depth of the ribs 35 and 36 for the cam surfaces is approximately 0.125 inches and the width of the helical groove 34 slightly more than 0.125 inches. In this relation, while the helical groove as formed by the confronting or complementary cam surfaces 35 and 36 is supported by the drum portions 31 and 32, it will be apparent that the cam surfaces could be of unitary construction and properly supported by other specific means than the part cylindrical surface portions on the central drive axle. It is therefore to be understood that various modifications and changes may be made in the particular construction and arrangement of elements comprising the present invention without departing from the spirit and scope thereof as defined by the appended claims.

What is claimed is:

1. In a printing apparatus having a frame, a print head including a drive member therefor, said print head adapted to impress numbers or other indicia on a record medium, the improvement comprising:

print head drive means engageable with the drive member on said print head to reversibly drive said print head in a print and return direction, said drive means including an elongated drive axle mounted for rotation on said frame, a substantially hollow, axially elongated drum segment having a pair of closely spaced generally helically extending rib members forming a cylindrical surface of revolution in outer spaced concentric relation to said drive axle, said rib members defining one axial end of said drum segment and forming a common helical groove between said rib members extending in the form of an endless loop between first and second points 180° removed from one another adjacent to opposite ends of said drive axle, a rigid support member extending between said drum segment and said drive axle to support said drum segment in outer concentric relation to said drive axle, and motor drive means for rotating said print head drive means whereby engagement of said drive member by said loop will impart linear, reversible movement to said print head as said drive member advances throughout a complete cycle of revolution of said loop.

2. In a printing apparatus according to claim 1, said helical loop engaged by said drive member whereby rotation of said drive axle will initiate movement of said print head between opposite ends of said loop in a print and return direction, respectively, the loop being of a configuration as defined by said rib members to decelerate said print head at one end of the loop while reversing its travel for movement in the return direction to a position opposite the said one end of said loop.

3. In a printing apparatus according to claim 2, said helical groove interrupted by a straight section adjacent to at least one end limit of travel whereby to reduce the translational rate of speed of said print head along a portion of its travel in the return direction.

4. In a printing apparatus according to claim 1, said motor drive means including a synchronous motor, and said drive member being in the form of a downwardly projecting stud inserted in said helical groove whereby to impart linear advancement to said print head across the record medium in response to rotation of said print head drive means.

5. In a calculator wherein a print head includes a drive member thereon and is adapted to undergo translational movement across a record medium to impress numbers thereon, the improvement comprising:

print head drive means engageable with the drive member on said print head to reversibly drive said print head in a print and return direction, said drive means including an elongated drive axle mounted for rotation on said frame, a pair of axially elongated, substantially hollow generally cylindrical drum segments mounted in outer concentric relation to said drive axle, and a pair of closely spaced generally helically extending cam surfaces extending along one axial end of said drum segments in outer spaced concentric relation to said drive axle, said cam surfaces defining a generally helical groove therebetween extending symmetrically in the form of an endless loop between diametrically opposed points of reversal 180° removed from one another adjacent to opposite ends of said drive axle, said helical groove interrupted by reduced pressure angle portions leading into each point of reversal, and motor drive means for rotating said print head drive means whereby engagement of said drive member by said loop will impart linear, reversible movement to said print head as said drive member is advanced throughout a complete cycle of revolution.

6. In a calculator according to claim 5, said motor drive means being operative to initiate movement of said print head from a start position intermediately of opposite ends of said groove through an end point of reversal preceding movement in a print and return direction, respectively, said groove being symmetrically disposed about said drive axle to permit said drive means to drive said print head alternately to print in either direction of travel with respect to the record medium.

7. In a calculator according to claim 6, said motor drive means including a synchronous motor, and said drive member being in the form of a downwardly projecting stud inserted in said helical groove whereby to impart linear advancement to said print head across the record medium in response to rotation of said motor drive means.

8. In a calculator according to claim 6, including indexing means for advancing the record medium having a drive arm at the end of said print head drive means, an eccentric member associated with said print head drive means and operative to impart curvilinear motion to said drive arm to index the record medium when said print head is advanced in the return direction, and means reversibly interconnecting said eccentric member with respect to said print head drive means whereby to correlate indexing of the record medium with the direction of printing and return of said print head.

9. In a printing apparatus having a frame and a print head including a drive member therefor, said print head adapted to impress numbers or other indicia on a record medium, the improvement comprising print head drive means engageable with the drive member, said drive means including a drive axle mounted for rotation on said frame, and inner and outer concentric, generally cylindrical drum segments arranged in telescoping relation to one another and secured to said axle, said drum segments each having a rib member disposed thereon and said rib members positioned in closely spaced relation to one another, said rib members defining a groove therebetween extending in an endless, generally helical loop, and drive means associated with said drive axle for rotating said drum segments whereby engagement of said drive member by said groove will impart movement to said print head.

10. In a printing apparatus according to claim 9, each of said rib members formed along one edge of each respective drum segment, said rib members defining a point of reversal at each margin of said apparatus.

11. In a printing apparatus according to claim 9, said outer drum segment defined by a generally cylindrical sleeve and said inner drum segment defined by a hollow cylindrical portion rigidly mounted in outer spaced concentric relation to said drive axle.

12. In a printing apparatus according to claim 11, said drum segments having locating means therebetween to effect alignment and joinder of said drum segments with said rib members arranged in uniformly spaced relation to one another throughout their length.

13. In a printing apparatus having a frame, a print head including a drive member therefor, said print head adapted to impress characters or other indicia on a record medium, the improvement comprising:

print head drive means engageable with the drive member on said print head to reversibly drive said print head in a print and return direction, said drive means including an elongated drive axle mounted for rotation on said frame, and an annular, truncated drum segment having a pair of closely spaced generally helically extending ribs extending about a cylindrical surface of revolution and being symmetrically disposed in outer spaced concentric relation to said drive axle, said drum segment being supported by said drive axle and said ribs defining a common helical groove therebetween extending in the form of an endless loop between points 180° removed from one another adjacent to opposite ends of said drive axle, motor drive means for rotating said print head drive means whereby engagement of said drive member by said loop will impart linear, reversible movement to said print head as said drive member advances throughout a complete cycle of revolution of said loop, and indexing means for advancing the record medium having a drive arm at the end of said print head drive means, an eccentric member interposed between said print head drive means and said drive arm operative to impart curvilinear motion to said drive arm to index the record medium when said print head is advanced in the return direction, and means reversibly interconnecting said eccentric member with respect to said print head drive means whereby to correlate indexing of the record medium with the direction of printing and return of said print head.

* * * * *